US005960984A

United States Patent [19]

Weston

[11] Patent Number: 5,960,984

[45] Date of Patent: Oct. 5, 1999

[54] INSERT FOR A BEVERAGE CONTAINER HOLDER

[76] Inventor: James W. Weston, 463 E. Green St., Monticello, Ga. 31064

[21] Appl. No.: 09/057,896

[22] Filed: Apr. 9, 1998

[51] Int. Cl.[6] ..... B65D 25/34

[52] U.S. Cl. ..... 220/739; 220/903; 220/23.91; 220/23.86; 220/23.89

[58] Field of Search ..... 220/903, 739, 220/23.91, 23.89, 23.86, 23.83

[56] References Cited

U.S. PATENT DOCUMENTS

| | | | |
|---|---|---|---|
| 397,163 | 2/1889 | Zinsser, Jr. | 220/23.91 |
| 3,782,195 | 1/1974 | Meek et al. . | |
| 4,183,226 | 1/1980 | Moore | 220/903 |
| 4,831,842 | 5/1989 | Kelley et al. | 220/903 |
| 4,919,983 | 4/1990 | Fremin . | |
| 4,928,873 | 5/1990 | Johnson | 220/739 |
| 4,986,089 | 1/1991 | Raab . | |
| 4,989,418 | 2/1991 | Hewlett . | |
| 5,005,374 | 4/1991 | Spitler . | |
| 5,022,235 | 6/1991 | Grissom . | |
| 5,188,877 | 2/1993 | Magaro . | |
| 5,212,963 | 5/1993 | McGinnis . | |
| 5,310,261 | 5/1994 | Blue et al. . | |
| 5,425,497 | 6/1995 | Sorensen | 220/903 |
| 5,454,497 | 10/1995 | Kettelson . | |
| 5,482,373 | 1/1996 | Hutchinson . | |
| 5,588,747 | 12/1996 | Belvins . | |
| 5,636,758 | 6/1997 | Su | 220/23.89 |
| 5,645,196 | 7/1997 | Hancuff . | |

*Primary Examiner*—Stephen Castellano
*Attorney, Agent, or Firm*—Kenneth L Tolar

[57] ABSTRACT

The present invention relates to an insert for a standard beverage container holder that assists a user in removing an empty beverage container therefrom. The device includes a substantially rectangular panel bendable to form a cylindrical beverage container receptacle. The panel has two opposing lateral side edges, longitudinal top and bottom edges perpendicularly disposed therebetween, a planar inner surface and an opposing planar outer surface. Protruding from the inner surface are a plurality ofjuxtaposed, substantially parallel ribs extending from the top edge to the bottom edge. Depending from the inner surface of the panel immediately adjacent the bottom edge thereof are a plurality of bendable flaps for supporting a beverage container in an upright position. The top and bottom edges each have a pair of opposing L-shaped latch members for securing the device to the upper and lower rims of the beverage container holder. To remove an empty beverage from the insert, a user places the bottom surface of the beverage container on the top surface of a full beverage and vertically slides the beverage container holder until the full beverage container completely supplants the empty container.

7 Claims, 1 Drawing Sheet

INSERT FOR A BEVERAGE CONTAINER HOLDER

BACKGROUND OF THE INVENTION

The present invention relates to a uniquely configured insert for a beverage container holder that allows a user to quickly and easily remove a beverage container therefrom.

DESCRIPTION OF THE PRIOR ART

Conventional beverage holders typically comprise a cylindrical, foam receptacle dimensioned to tightly receive a beverage container such as a bottle or can. Because the slightly flexible holder tightly surrounds the beverage container, removing an empty container is often arduous and laborious. The beverage holder must be contorted until such time a user can sufficiently grasp the can to pull it therefrom. Some beverage holders have open top and bottom ends allowing a user to push the beverage container at one end to displace it from the other. However, an empty can will still tend to adhere to the interior surface of the holder making it difficult to remove therefrom.

Several beverage holders and similar devices for insulating a beverage exist in the prior art. For example, U.S. Pat. No. 5,022,235 issued to Grissom relates to a beverage cooler apparatus comprising a cup shaped support receivably mounted within a second cup shaped support each having aligned recesses directed downwardly from their top edges allowing the user to more easily access a beverage container resting therein.

U.S. Pat. No. 4,831,842 issued to Kelley et al relates to a cooling jacket for a beverage container comprising a hollow cylindrical structure made of washable durable fabric coated with an insulating backing. The device further includes a receptacle for receiving a plurality of freezable pockets.

U.S. Pat. No. 4,989,418 issued to Hewlett relates to a cooling wrap comprising a heat absorbing blanket having fastening means on opposed sides thereof for securing the blanket around a beverage container.

U.S. Pat. No. 5,325,988 issued to Ekem relates to an insulated jacket for a beverage bottle comprising two engaging cup shaped members which are connected with an elastic cord allowing a first cup shaped member to be removed from the container without being completely separated from the other.

U.S. Pat. No. 4,798,063 issued to Rimmer relates to a cylindrical beverage holder comprising a plurality of wall layers each varying in density. Circular ribs are formed on an inner wall for providing air gaps to enhance cooling. A bottom mounted enclosure is filled with a freezable liquid for further cooling.

Although several beverage container holders for maintaining a beverage at a constant temperature exist in the prior art, none relate to a device for securing within a conventional beverage holder that not only further insulates the beverage but also assists a user in removing it from the beverage holder. The present invention provides an insert securable to the inner surface of a beverage holder which releasably receives a beverage container therein. The insert is configured to support a beverage in an upright position under normal conditions but will release the beverage container more easily than conventional beverage holders when force is applied thereto.

SUMMARY OF THE INVENTION

The present invention relates to an insert for securing to the inner wall of a conventional beverage container holder.

The device comprises a substantially rectangular panel made from a rigid but bendable material allowing the device to be rolled to form a cylindrical beverage receptacle. The panel has two opposing lateral side edges with longitudinal top and bottom edges perpendicularly disposed therebetween. Extending from opposing ends of the top and bottom edges is an L-shaped latch member for receiving either the upper or lower rim of a beverage container holder. Protruding from a side of the panel are a plurality of vertically aligned, substantially parallel ribs. The top and bottom edges each have a plurality of slots integral therewith allowing the device to expand slightly. Horizontally extending from the bottom edge are a plurality of juxtaposed, flexible flaps for engaging the bottom of a beverage container to suspend the container within the insert. Protruding from a side of the panel opposite the ribs are a plurality of spurs for frictionally engaging the inner surface of a beverage holder to prevent the insert from slipping or shifting. Accordingly, the panel may be bent to a substantially cylindrical configuration with the lateral side edges adjacent each other and the ribs facing inwardly. The device is inserted into a beverage container holder with the L-shaped latch members secured to the top and bottom rims of the holder to secure the device therein. It is therefore an object of the present invention to provide an insert for a beverage container holder that allows a user to quickly and easily supplant a beverage received therein.

It is yet another object of the present invention to provide an insert for a beverage container holder that increases the insulating capability of a standard beverage container holder.

It is yet another object of the present invention to provide an insert for a beverage container holder that may selectively expand to receive various sized beverage containers. Other objects, features and advantages of the present invention will become readily apparent from the following detailed description of the preferred embodiment when considered with the attached drawings and the appended claims.

DESCRIPTION OF THE PREFERRED EMBODIMENT

Figure 2:
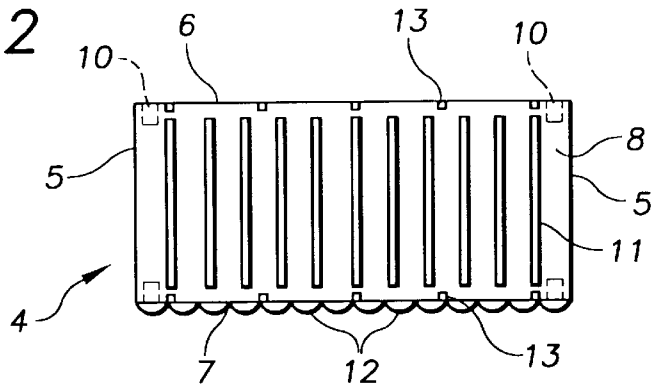
FIG. 2 depicts the inventive device in an unrolled, planar position.
Figure 3:
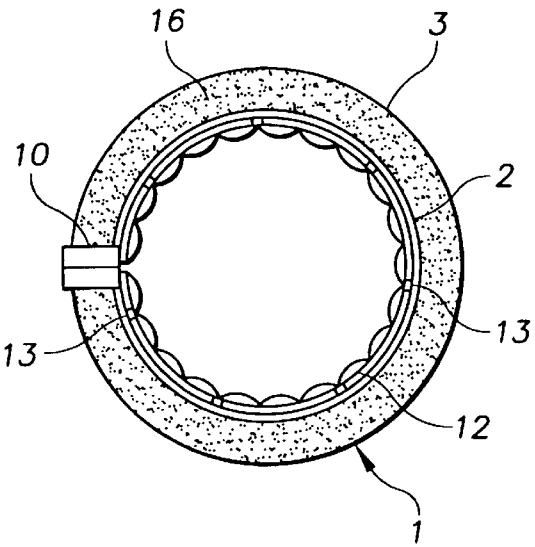
FIG. 3 depicts an end view of a conventional beverage container holder with the inventive device received therein.
Figure 1:
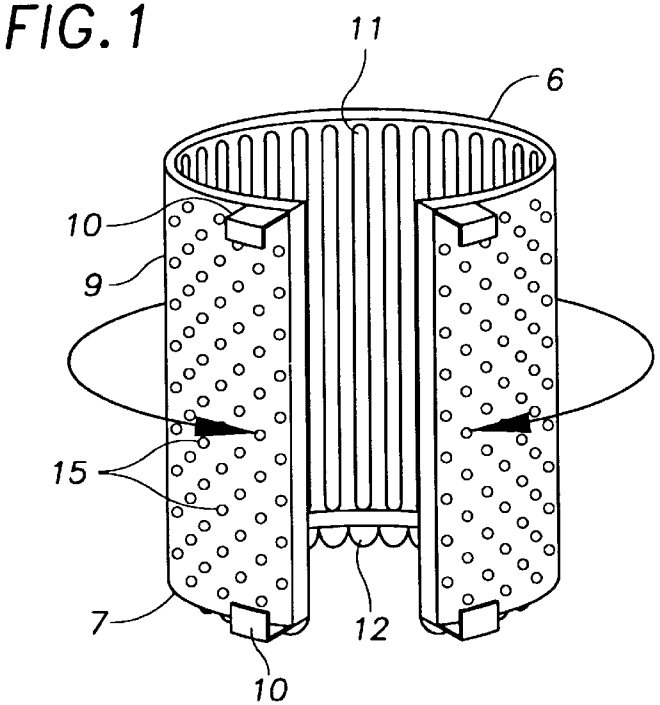
FIG. 1 depicts the inventive device bent to form a cylindrical insert.

Referring now to FIGS. 1 through 3, the present invention relates to an insert for a standard beverage container holder 1. A conventional beverage container holder 1 generally comprises a hollow, substantially cylindrical chamber having circular inner 2 and outer 3 walls with an upper and lower rim 16 therebetween. The holder is typically made from a foam rubber, fabric or a similar insulating material. One or both ends of the holder are open to receive a beverage container such as a bottle or can.

The present invention relates to an insert for a beverage container holder of the type described above especially those in which both the top and bottom ends are open. The invention comprises a substantially rectangular panel 4 having two opposing lateral side edges 5 with longitudinal top 6 and bottom 7 edges perpendicularly disposed therebetween. The panel also has a substantially planar inner surface 8 and an opposing planar outer surface 9. The panel is made from a slightly rigid but flexible material so that the panel may be rolled to form a substantially cylindrical beverage receptacle as depicted in FIG. 1.

On the top and bottom edges are a pair of substantially L-shaped latch members 10 each proximal a contiguous side edge for receiving either the upper or lower rim of the beverage container holder. Integrally protruding from the inner surface of the panel are a plurality of juxtaposed, substantially parallel ribs 11 extending from the top edge to the bottom edge. The ribs are smooth and slightly flexible so that various diameter beverage containers will easily slide into or out of the device when in a cylindrical configuration.

Horizontally extending from the inner surface of the panel adjacent its bottom edge are a plurality ofjuxtaposed bendable flaps 12 for engaging the bottom surface of a beverage container. The horizontal flaps are substantially perpendicular to the panel to form a bottom retainer for the beverage container when placed into the insert. The bendable flaps have sufficient resilience to suspend a fall beverage container thereon but will bend and release the beverage container when a predetermined force is applied thereto.

Integral with the top and bottom edges are a plurality of spaced slots 13 allowing the top and bottom edges of the panel to expand slightly when a beverage is inserted therein. Protruding from the outer surface of the panel are a plurality of spurs 15 for frictionally engaging the inner wall of the holder to prevent the insert from shifting or slipping.

To use the above described device, the panel is rolled back onto itself with the opposing side edges adjacent each other and the ribs facing inwardly to form a substantially cylindrical receptacle that conforms to the inner wall of the conventional holder as depicted in FIG. 1. The device is inserted into a standard beverage container holder with the upper pair of adjacent L-shaped latches secured to the upper rim of the beverage container holder and the lower pair secured to the lower rim thereof. A beverage container is then inserted into the top end of the receptacle until it rests on the bendable flaps. When removing an empty beverage, the bottom surface of the empty beverage container is placed on the top surface of a full beverage container. The beverage container holder and attached insert are slid downwardly such that the full beverage container quickly supplants the empty container.

The above described device is designed to receive various size beverage containers. The adjacent but unattached side edges form a disjunctive seam that allows the circumference of the device to expand or contract depending upon the diameter of a beverage inserted therein. Furthermore, the slots integral with the top and bottom edges allow the access openings formed thereby to expand slightly as well.

The panel, spurs and ribs are preferably constructed with a polyethylene plastic material such that the device is flexible but resilient. The plastic insert is configured riot only to assist a user in replacing a beverage container within a holder, but also supplements the holder to provide additional insulating properties thereto. As will be readily apparent to those skilled in the art, the size, shape and materials of construction of the various components may be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. In combination with a substantially cylindrical beverage container holder having circular top and bottom rims which define openings, an inner wall and an outer wall, an insert comprising:

a substantially rectangular, bendable but rigid panel having two opposing lateral side edges with longitudinal top and bottom edges perpendicularly disposed therebetween, a substantially planar inner surface and an opposing substantially planar outer surface, said panel bendable to form a substantially cylindrical receptacle receivable within said holder;

means for selectively suspending a beverage container within said panel when bent to its cylindrical configuration;

means for removably securing the cylindrical receptacle within a beverage container holder.

2. An insert according to claim 1 further comprising:

a plurality ofjuxtaposed longitudinal ribs protruding from the inner surface of said panel to further insulate a beverage and to assist a user in sliding a beverage into or out of the cylindrical receptacle.

3. An insert according to claim 1 wherein said means for selectively suspending a beverage container within said panel comprises:

a plurality of juxtaposed flaps horizontally extending from the inner surface of said panel immediately adjacent the bottom edge thereof, said flaps having sufficient rigidity to suspend a full beverage container thereon and sufficient flexibility to release said beverage container when a predetermined force is applied thereto.

4. An insert according to claim 1 further comprising a plurality of spurs protruding from the outer surface of said panel for frictionally engaging the inner wall of the beverage container holder.

5. An insert according to claim 1 wherein said means for securing said cylindrical receptacle to a beverage container holder comprises a pair of opposed L-shaped latch members attached to the top edge of said panel, each adjacent an opposing side edge thereof for receiving the top rim of the beverage container holder;

a pair of L-shaped latch members attached to the bottom edge of said panel, each adjacent an opposing side edge thereof for receiving the bottom rim of the beverage container holder.

6. An insert according to claim 1 wherein said top and bottom edges further include a plurality of spaced slots integral therewith to increase the expansibility of said top and bottom edges.

7. In combination with a substantially cylindrical beverage container holder having circular top and bottom rims which define openings, an inner wall and an outer wall, an insert comprising:

a substantially rectangular, bendable but rigid panel having two opposing lateral side edges with longitudinal top and bottom edges perpendicularly disposed therebetween, a subtantially planar inner surface and an opposing substantially planar outer surface, said panel bendable to form a substantially cylindrical receptacle receivable within said holder;

means for selectively suspending a beverage container within said panel when bent to its cylindrical configuration;

means for securing the cylindrical receptacle within a beverage container holder, said means comprising a pair of opposed latch members attached to the top edge of said panel for receiving the top rim of the beverage container holder;

a pair of latch members attached to the bottom edge of said panel for receiving the bottom rim of the beverage container holder.

* * * * *